US007266934B2

(12) United States Patent
Leighton

(10) Patent No.: US 7,266,934 B2
(45) Date of Patent: Sep. 11, 2007

(54) RECLOSABLE BAG PRODUCTION

(75) Inventor: Murray Edward Bruce Leighton, Harrogate (GB)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/523,482

(22) PCT Filed: Aug. 7, 2003

(86) PCT No.: PCT/GB03/03449

§ 371 (c)(1),
(2), (4) Date: Sep. 22, 2005

(87) PCT Pub. No.: WO2004/014731

PCT Pub. Date: Feb. 19, 2004

(65) Prior Publication Data

US 2006/0111225 A1 May 25, 2006

(30) Foreign Application Priority Data

Aug. 8, 2002 (GB) ..... 0218420

(51) Int. Cl.
*B65B 51/04* (2006.01)

(52) U.S. Cl. ..... 53/133.4; 53/412; 53/451; 493/212; 493/214; 493/927; 383/63

(58) Field of Classification Search ..... 53/412, 53/451, 551, 133.4, 139.2; 493/212–215, 493/927; 383/63, 64
See application file for complete search history.

(56) References Cited

U.S. PATENT DOCUMENTS 5,564,259 A * 10/1996 Stolmeier ..... 53/410
6,017,412 A * 1/2000 Van Erden et al. ..... 156/290
6,085,491 A 7/2000 Bois ..... 53/412
6,088,998 A * 7/2000 Malin et al. ..... 53/416
6,131,369 A * 10/2000 Ausnit ..... 53/412
6,151,868 A 11/2000 Matthews ..... 53/451
6,212,857 B1 * 4/2001 Van Erden ..... 53/412
6,530,870 B2 * 3/2003 Buchman et al. ..... 493/394
6,751,932 B1 * 6/2004 Matthews ..... 53/412
2002/0139704 A1 10/2002 Buchman ..... 206/459.1

FOREIGN PATENT DOCUMENTS

| | | |
|---|---|---|
| FR | 2 772 004 | 6/1999 |
| GB | 211 573 | 2/1924 |
| GB | 2 184 209 A | 6/1987 |
| GB | 2 349 603 A | 8/2000 |
| NL | 1 020 510 | 3/2003 |
| WO | WO 02/06040 A1 | 1/2002 |
| WO | WO 2004/014731 A1 | 2/2004 |

* cited by examiner

*Primary Examiner*—Hemant M. Desai
(74) *Attorney, Agent, or Firm*—Woodcock Washburn LLP

(57) ABSTRACT

The bags are produced on a form-fill seal machine operating horizontally or vertically. Zipper strips (16) are initially attached to a continuous web (12) which is subsequently formed into a continuous run of bags having end seals (20) and a back seal (18). The continuous run is separated into individual bags and the zipper strips finally attached to the bag walls by application of heat and/or pressure by a belt sealer (26) operating in a direction perpendicular to that of movement of the continuous web.

22 Claims, 2 Drawing Sheets

RECLOSABLE BAG PRODUCTION

This application is the national stage filing under 35 U.S.C. §371 of PCT Application No. PCT/GB03/03449 filed on Aug. 7, 2003.

BACKGROUND OF THE INVENTION

This invention relates to the production of reclosable bags which have a reclosable seal formed by releasable and engagable zipper strips attached to opposed walls of the bag.

The reclosable seal is often provided adjacent a nonreclosable seal, for example a heat seal, and allows the bag to be reclosed with the non-reclosable seal has been opened. Such bags are often formed by use of a horizontal or a vertical form-fill-seal machine.

In preparing continuous web material for supply to a form-fill-seal machine, or other apparatus for forming bags having reclosable seals, a continuous length of web material from which the bags are to be formed is advanced in a longitudinal direction and separate lengths of zipper strip are applied to the web so that they are at spaced intervals longitudinally of the web and extend transversely (usually perpendicularly) to the longitudinal direction. Each zipper strip length comprises first and second interengagable profiles which are pre-assembled into at least partial engagement with each other. This is known as "cross-web technology": see our published UK patent application GB-A-2349603 which describes a form-fill-seal machine using that technology and the entire contents of which are incorporated herein by reference. FIG. 5 of GB-A-2349603 shows the use of a pair of spring-loaded zipper sealing jaws which operate to seal the zipper strips to the walls of the bag simultaneously with formation of the non-reclosable end seal of the bag. This operation requires a certain time as it is necessary for the zipper sealing jaws to supply heat to the zipper strips to seal them to the bag walls. The steptherefore slows down the entire form-fill-seal operation.

SUMMARY OF THE INVENTION

According to the present invention, there is provided a method of making a reclosable bag, comprising the steps of:

supplying a continuous web of bag-forming material in a first direction to a bag-forming station;

attaching to the continuous web a plurality of zipper strips at intervals spaced in the first direction and extending transversely of the web, each zipper strip comprising first and second interengagable profiles preassembled into at least partial engagement with each other;

forming end-sealed bags at the bag-forming station, each bag having opposed first and second walls, at least one of which is formed from the said continuous web of material, first and second end seals, and therebetween at least one of the zipper strips attached to a respective wall of the bag; and treating the bags adjacent the respective zipper strip profiles in order to secure the profiles to the first and second walls respectively and to form an openable and reclosable seal inside the bags.

In a method according to the present invention, the respective zipper strip profiles are not finally attached to the bag walls until after the bag has been formed.

In a preferred form of the invention, the zipper strips are initially attached to the continuous web only sufficiently to hold them in position: final securement takes place only after formation of the bag.

The step of treatment of the walls of the bag to secure the zipper profiles may take place before or after the web has been separated into individual bags but preferably takes place after separation of the continuous web into individual bags.

Initial attachment and/or securement of the zipper strip profiles to the bag walls can be by means of pressure-sensitive or heat-sensitive adhesive, by fusing of the material of the bags and/or the strips under the application of heat and/or pressure, or by any other suitable means. The means for initial attachment and for subsequent securement may be the same or different.

Separation of the continuous web. into individual bags prior to the securement of the zipper strips to the bag walls allows securement to take place at a securement station prior to which the bags are reorientated so that they are fed to the securement station with their zipper strips aligned along a common axis.

The common axis may be parallel to the direction of supply of the continuous web but is-preferably transverse to that direction, most preferably perpendicular thereto.

Preferably, the bags are treated by the application of heat and/or pressure to secure the zipper-strip profiles to the bags.

Conveniently, the bags are treated by a belt sealer.

Advantageously, the direction of supply of the continuous web is substantially horizontal and the common axis is substantially horizontal.

Preferably, the direction of supply of the continuous web is substantially vertical and the common axis is substantially horizontal.

The invention also provides an apparatus for making a reclosable bag, the apparatus comprising successively:

means for supplying a continuous web of bag-forming material in a first direction:

means for attaching to the continuous web a plurality of zipper strips at intervals spaced in the first direction and extending transversely of the web, each zipper strip comprising first and second interengagable profiles preassembled into at least partial engagement with each other;

a bag-forming station at which are formed bags having opposed first and second walls, at least one of which is formed from the continuous web of material, first and second end seals and therebetween and attached to a respective wall of the bag at least one of the zipper strips; and means for treating the bags adjacent the respective zipper strip profiles to secure the profiles to the first and second walls respectively and to form an openable and reclosable seal inside the bags.

Preferably, the apparatus comprises means located between the bag-forming station and the securement means for separating the continuous web into individual bags.

Advantageously, the apparatus comprises means located between the separating means and the securement means for reorientating the separated bags so that their respective zipper strips are aligned one with another along a common axis.

The securement means preferably comprises means for conveying the bags through a treatment zone, where the bags are treated with heat and/or pressure, or otherwise, to secure the zipper-strip profiles to the walls of the bags.

The conveying means advantageously engage the zipper-strip profiles, whilst making contact with the respective outer surfaces of the walls of the bags.

Preferably, the conveying means also effect the treatment to secure the profiles to the bag walls. Conveniently, this is achieved by application of heat and/or pressure by way of the conveying means, for example by the conveying means comprising a belt sealer.

In the present invention, separation of the individual bags and reorientation of the bags before securement of the zipper strips allows the rate of bag production to be high because the zipper strips can be secured in a shorter time period than could be achieved by securement whilst the bags still formed a continuous web.

BRIEF DESCRIPTION OF THE FIGURES

An embodiment of the invention will now be described by way of example with reference to the drawing of this specification; in which.

DETAILED DESCRIPTION OF ILLUSTRATIVE EMBODIMENTS

Figure 1:
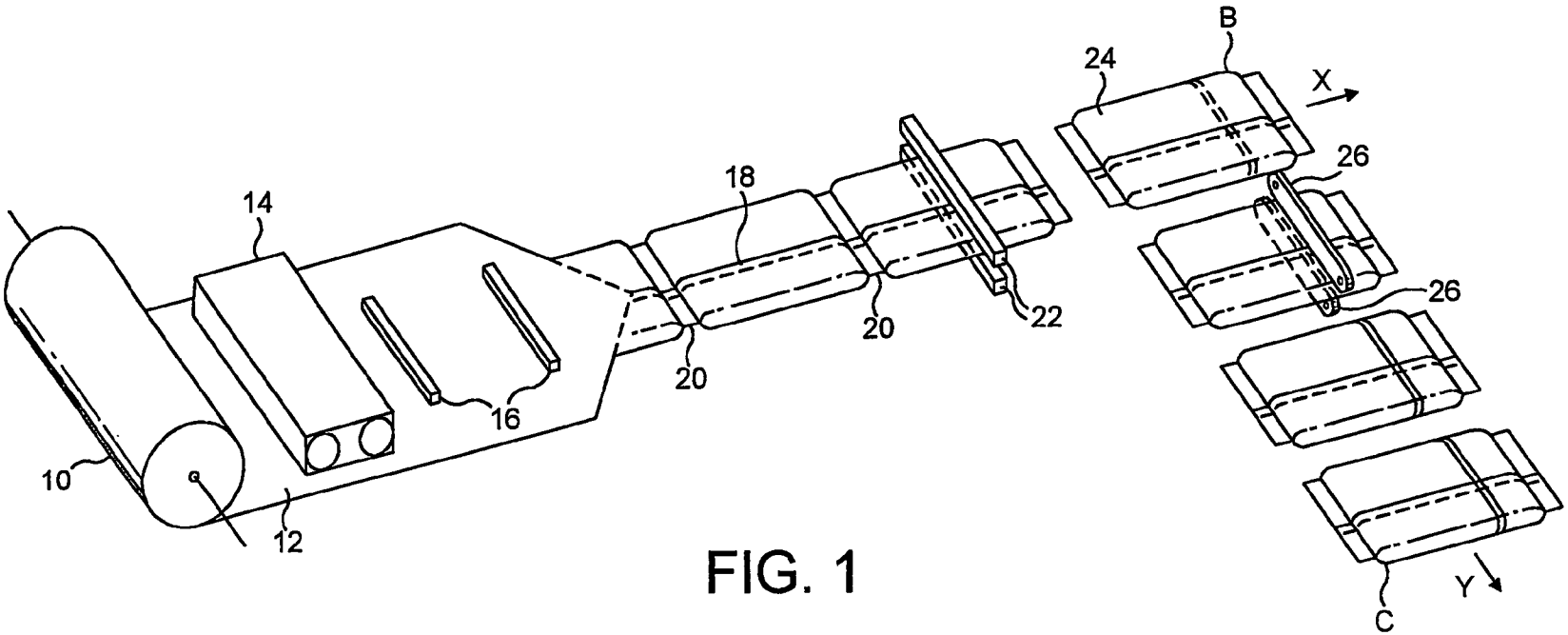
FIG. 1 is a somewhat schematic drawing of a horizontal form-fill-seal apparatus using cross-web technology.

Referring to FIG. 1, this shows a storage roll 10 of web material 12, for example polyethylene. The web material 12 is advanced from the roll 10 past a cross-web applicator 14 at which lengths of zipper 16 are attached to the web at spaced intervals in the direction of advancement of the web, shown by the arrow "X" in FIG. 1. The cross-web applicator is preferably as described in our copending International Patent Application PCT/GB2003/002158 (the entire contents of which are incorporated herein by reference), claiming priority from UK Application 0211573.1 but any suitable apparatus may be used, for example that described in GB-A-2349603 referred to above.

Each length of zipper consists of a first and a second interengagable profile, which are respectively "male" and "female" in cross-sectional shape. Each profile has a respective surface for attachment to the web material. An example of suitable zipper profiles can be seen in our published international Patent Application WO-A-02/06040 (the entire contents of which are incorporated herein by reference). The attachment surfaces extend in spaced parallel planes when the profiles are in engagement with each other. As seen in FIG. 1, the lengths of zipper 16 are attached to the web 12 by the formation of a tack_seal between the flange of one zipper profile an the web material 12. Each length of zipper 16 is approximately one-half the width of the web material 12. The lengths are positioned approximately mid-way between the longitudinal edges of the web material.

After application of the lengths of zipper 16, the web material 12 is formed into a tubular shape by the form-fill-seal apparatus. This is shown only schematically in FIG. 1. In this operation, the longitudinal edges of the web material 12 are brought together to form a back seal 18 which is made by the action of heated clamping bars (not shown).

Similarly, transverse end seals 20 are formed by the action of further heated clamping bars 22. During this operation, product is introduced into the bags being formed. The means for doing this are not shown in FIG. 1 but they are wellknown in the field of form-fill-seal apparatus. Formation of the back seal 18 and the end seals 20 produces a continuous length of bags which is then cut into separate individual bags 24 by cutting means (again not shown but well-known in the field of form-fill-seal apparatus).

Figure 2:
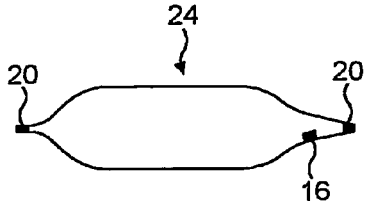
FIG. 2 is a longitudinal sectional view of a bag at an intermediate stage in the production of bags using the apparatus of FIG. 1, the bag being as at the stage indicated by the letter "B" in FIG. 1.

An individual bag as first produced is shown by the letter "B" in FIG. 1 and in longitudinal section in FIG. 2.

FIG. 2 shows the bag to have an end seal 20 at each end and a length of zipper 16 tack-sealed to one wall of the bag inside the bag and adjacent one of the end seals 20. The tack-seal of the length of zipper 16 to the material of the bag is between the outer surface of one zipper profile and the bag. The other zipper profile is engaged with the first zipper profile, at least to the extent necessary to hold-the profiles in the correct alignment for their engagement. Normally, the profiles will be fully engaged.

After the continuous length, of bags has been cut into individual bags 24, the bags are moved laterally from the direction of advancement of the web 12, shown by the arrow "X" in FIG. 1, into a line perpendicular thereto and shown by the arrow "Y" in FIG. 1.

After lateral movement of the bags 24 into the direction of the arrow "Y" the bags are engaged by a belt sealer comprising a pair of heated gripping guides 26. One of the guides 26 engages the outer surface of the bag 24 immediately adjacent the respective zipper profile which is tack-sealed to the inner surface of the bag. The relatively stiff zipper profile facilitates this engagement between the respective guide 26 and the bag 28. At the same time, the other guide 26 engages the other zipper profile through the material of the bag.

The engagement of the guides 26 with the zipper 16 through the material of the bag not only allows the bags to be conveyed further in the direction of arrow "Y" but also effects complete sealing of the zipper profiles to the respective inner surfaces of the walls of the bag. This complete sealing can be brought about by heat or pressure, or by both, or by any other suitable means. At the same time, the zipper profiles are, if not already, brought into complete engagement with each other.

Figure 3:
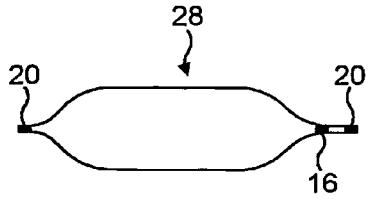
FIG. 3 is a view similar to FIG. 2 but showing the finished bag, as at the stage indicated by the letter "C" in FIG. 1.

The final bag 28 is shown by the letter "C" in FIG. 1 and in longitudinal section in FIG. 3. It will be seen from FIG. 3 that the final bag has non-reclosable end seals 20 and a reclosable seal formed by the zipper 16 inside the bag. This allows the bag to be resealed by means of the zipper 16 after it has been opened by opening the non-reclosable end seal 20 adjacent the zipper 16.

Figure 4:
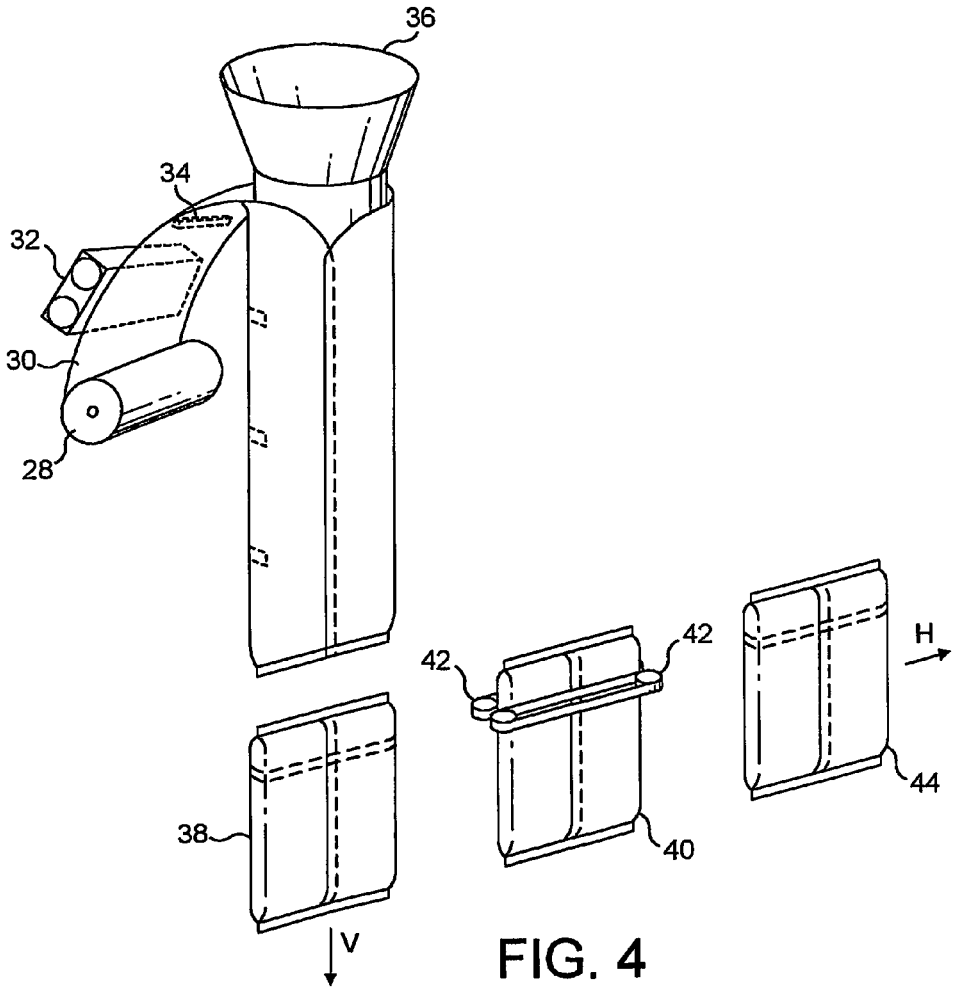
FIG. 4 is a schematic drawing of a vertical form-fillseal apparatus using cross-web technology.

The present invention is equally applicable to vertical form-fill-seal machines and to methods operated on such machines, as can be seen from the embodiment shown in FIG. 4.

In FIG. 4, an apparatus for forming, filling and sealing bags in the vertical direction is shown which works in a substantially similar way to that shown in FIG. 1 and described above. A storage roll 28 feeds web material 30 past a cross-web applicator 32 which attaches lengths of zipper 34 at spaced intervals. The web material 30 is formed into a tubular shape around the vertical form-fill-seal apparatus 36. As described above, the web material 30 is formed, filled, sealed and separated to give individual bags, such as bag 38. This whole process is performed in the vertically downward direction shown as "V". Once the bags are separated, they are moved in the horizontal direction "H" perpendicular to the direction "V". The bags are then passed through a belt sealer comprising a pair of heated gripping guides 42. As shown in FIG. 4, the outer surfaces of bag 40 are gripped between the guides 42 which both complete sealing of the zipper profiles to the respective inner surfaces of the walls of the bag 40 and direct the bag 40 in the direction "H". As mentioned above, this process also ensures that the zipper profiles are brought into complete engagement with each other, to give a completed sealed bag 44.

It will be noted that, in the bag production method of the invention, the sealed bag (as in FIG. 2) is first formed with the zipper attached to only one wall thereof. The zipper is attached to the other wall after formation of the sealed bag.

The present invention may be embodied in other specific forms without departing from the spirit or essential attributes thereof and, accordingly, reference should be made to the appended claims, rather than to the foregoing specification, as indicating the scope of the invention.

The invention claimed is:

1. A method of making a reclosable bag, comprising the steps of:

supplying a continuous web of bag-forming material in a first direction to a bag-forming station;

attaching to the continuous web a plurality of zipper strips at intervals spaced in the first direction and extending transversely of the web, each zipper strip comprising first and second interengagable profiles pre-assembled into a least partial engagement with each other;

forming end-sealed bags at the bag-forming station, each bag having opposed first and second walls, at least one of which is formed from the said continuous web of material, first and second end seals, and therebetween at least one of the zipper strips attached to a respective wall of the bag; and after the step of forming the end-sealed bags, treating the bags adjacent the respective zipper strip profiles in order to secure the profiles to the first and second walls respectively and to form an openable and reclosable seal inside the bags.

2. A method according to claim 1, in which the zipper strips are initially attached to the continuous web only sufficiently to hold them in position, final securement taking place in the said step of treating the bags.

3. A method according to claim 1, in which the step of treating the bags takes place after the web has been separated into individual bags.

4. A method according to claim 3, in which the treating step takes place at a securement station, prior to which the bags are reorientated so that they are fed to the securement station with their zipper strips aligned along a common axis.

5. A method according to claim 4, in which the common axis is transverse to the direction of supply of the continuous web.

6. A method according to claim 4, wherein the direction of supply of the continuous web is substantially horizontal and the common axis is substantially horizontal.

7. A method according to claim 4, wherein the direction of supply of the continuous web is substantially vertical and the common axis is substantially horizontal.

8. A method according to claim 1, in which the bags are treated by the application of heat and/or pressure to secure the zipper-strip profiles to the bags.

9. A method according to claim 1, wherein the bags are treated by a belt sealer.

10. The method according to claim 1 wherein the step of treating the bags occurs before the web is separated into individual bags.

11. An apparatus for making a reclosable bag, the apparatus comprising successively:

means for attaching to the continuous web a plurality of zipper strips at intervals spaced in the first direction and extending transversely of the web, each zipper strip comprising first and second interengagable profiles pre-assembled into a least partial engagement with each other;

a bag-forming station at which are formed bags having opposed first and second walls, at least one of which is formed from the continuous web of material, first and second end seals and therebetween and attached to a respective wall of the bag at least one of the zipper strips; and means for treating the bags adjacent the respective zipper strip profiles, located after the bag-forming station, to secure the profiles to the first and second walls respectively and to form an openable and reclosable seal inside the bags.

12. An apparatus according to claim 11, further comprising means located between the bag-forming station and the treatment means for separating the continuous web into individual bags.

13. An apparatus according to claim 12, further comprising means located between the separating means and the treatment means for reorientating the separated bags so that their respective zipper strips are aligned one with another along a common axis.

14. An apparatus according to claim 13, in which the common axis is transverse to the direction of supply of the continuous web.

15. An apparatus according to claim 13, wherein the direction of supply of the continuous web is substantially horizontal and the common axis is substantially horizontal.

16. An apparatus according to claim 13, wherein the direction of supply of the continuous web is substantially vertical and the common axis is substantially horizontal.

17. An apparatus according to claim 12, in which the treatment means comprises means for conveying the bags through a treatment zone where the bags are treated to secure the zipper-strip profiles to the walls of the bags.

18. An apparatus according to claim 17, in which the conveying means engage the zipper-strip profiles, whilst making contact with the respective outer surfaces of the walls of the bags.

19. An apparatus according to claim 18, in which the conveying means effect the treatment to secure the profiles to the bag walls.

20. An apparatus according to claim 19, in which the conveying means comprise a belt sealer.

21. An apparatus according to claim 11, in which the means for treating the bags apply heat and/or pressure to secure the zipper-strip profiles to the bags.

22. The apparatus according to claim 11 further comprising means located downstream of the treatment means for separating the continuous web into individual bags.

* * * * *

UNITED STATES PATENT AND TRADEMARK OFFICE

CERTIFICATE OF CORRECTION

PATENT NO. : 7,266,934 B2
APPLICATION NO. : 10/523482
DATED : September 11, 2007
INVENTOR(S) : Murray Edward Bruce Leighton It is certified that error appears in the above-identified patent and that said Letters Patent is hereby corrected as shown below:

In column 5, line 23, in Claim 1, delete "a" and insert -- at --, therefor.

In column 6, line 3, in Claim 11, delete "the" and insert -- a --, therefor.

In column 6, line 3, in Claim 11, after "web" insert -- of bag-forming material supplied in a first direction, --.

In column 6, line 7, in Claim 11, delete "a" and insert -- at --, therefor.

Signed and Sealed this

Twenty-first Day of December, 2010

David J. Kappos

David J. Kappos
*Director of the United States Patent and Trademark Office*